US008493393B2

(12) United States Patent
Yao et al.

(10) Patent No.: US 8,493,393 B2
(45) Date of Patent: Jul. 23, 2013

(54) APPARATUS AND METHOD FOR DISPLAYING GRAPHICS

(75) Inventors: Li Yao, Nanshan (CN); Xuguang Ci, Nanshan (CN)

(73) Assignee: Shenzhen Mindray Bio-Medical Electronics Co, Ltd., Shenzhen (CN)

( * ) Notice: Subject to any disclaimer, the term of this patent is extended or adjusted under 35 U.S.C. 154(b) by 1462 days.

(21) Appl. No.: 11/607,476

(22) Filed: Nov. 30, 2006

(65) Prior Publication Data

US 2007/0263006 A1 Nov. 15, 2007

(30) Foreign Application Priority Data

May 12, 2006 (CN) ..... 2006 1 0035494

(51) Int. Cl.
*G09G 5/00* (2006.01)

(52) U.S. Cl.
USPC ..... 345/502

(58) Field of Classification Search
CPC ..... G09G 2360/06; G09G 5/003; G09G 5/395; G06T 2210/52
USPC ..... 345/502–506
See application file for complete search history.

(56) References Cited

U.S. PATENT DOCUMENTS

| | | | | |
|---|---|---|---|---|
| 5,426,756 | A * | 6/1995 | Shyi et al. | 711/159 |
| 6,317,813 | B1 * | 11/2001 | Su et al. | 711/158 |
| 6,631,457 | B1 * | 10/2003 | Ohba | 711/200 |
| 6,952,213 | B2 * | 10/2005 | Ebihara | 345/505 |
| 7,525,548 | B2 * | 4/2009 | Azar et al. | 345/504 |
| 2004/0008200 | A1 * | 1/2004 | Naegle et al. | 345/505 |

FOREIGN PATENT DOCUMENTS

| | | |
|---|---|---|
| CN | 1629928 | 6/2005 |
| KR | 20010046844 | 6/2001 |

OTHER PUBLICATIONS

PCI core User's Guide; PLD Applications, France; Version 5.1.7, Aug. 22, 2002, pp. 1-77.*

* cited by examiner

*Primary Examiner* — Jeffery A Brier
(74) *Attorney, Agent, or Firm* — Kory D. Christensen; Stoel Rives LLP

(57) ABSTRACT

An apparatus for displaying graphics includes a memory to store graphics data and output the graphics data to the bus in series, and a plurality of transform modules, wherein, each transform module, based on a type of the graphics outputted to the bus and employing a feedback signal provided by each transform module after a transform operation is executed therein, transforms the corresponding graphics data into image information for the display memory in turn.

11 Claims, 2 Drawing Sheets

APPARATUS AND METHOD FOR DISPLAYING GRAPHICS

RELATED APPLICATION DATA

This application claims priority to Chinese Application No. 200610035494.2 filed on May 12, 2006, the entire disclosure of which is incorporated herein by reference.

BACKGROUND

1. Field

The present application relates to an apparatus and method for displaying graphics, and more particularly, to an apparatus and method that can accelerate the display of graphics.

2. Background Art

In clinical practice, monitor (e.g. patient monitor) plays an important role in diseases diagnosis because it can display various human physiological parameters dynamically.

In order to provide more comprehensive and accurate reflection of human physiological conditions, the monitoring function of a modern monitor has been extended from the ECG (electrocardiogram) monitoring to measurement of various human physiological parameters, such as blood pressure, respiration rate, Saturation of Pulse Oxygen (SpO2) and so on. However, the more physiological parameters are shown on the monitor, the higher a resolution is needed for the monitor, that is, the more video data is needed to generate images. Therefore, how to accurately display large numbers of data reflecting physiological parameters in real time has become a significant criterion for evaluating the performance of a patient monitor.

For a modern monitor, information display speed can only be improved limitedly by any of increasing the frequencies of processor and system bus, applying high-performance data bus configuration (e.g., PCI-Express) and employing general display driver IC chip, while the costs for the monitor are notably increased. Further, it is difficult for such monitor to provide flexible extension of displayed physiological parameters according to the user's need.

Recently, a display memory (also referred to as Video RAM) mapping technology has been proposed to improve the information display speed. The technology, based on design of the state machine, achieves transform operations for mapping the graphics data to be displayed into image information for display memory by means of the FPGA (Field Programmable Gate Array).

FIG. 1 shows an apparatus using the display memory mapping technology to display graphics in existing monitors. The apparatus comprises: a data source 5, an embedded processor for example, to generate graphics or image data to be displayed; a memory 10 to store the graphics data that comprises screen coordinates and chroma data for graphics such as point, line, rectangle and so on, wherein, the screen coordinates can be Cartesian coordinates for example and the chroma data comprises the data such as color or gray level; a transform module 20, based on the trigger condition of a state machine, to transform the graphics data of different graphics into image information for the display memory, the image information comprising mapping addresses transformed from the screen coordinates and chroma information transformed according to the color and gray level data; a display memory read/write module 30, based on the mapping addresses, to store image information with regard to the corresponding pixels on the display screen into a display memory 40; and a display timing control module 50, under the control of which, the image information read by the display memory read/write module 30 from the display memory is presented on the screen of a display 60 as the brightness or color of pixels at corresponding positions.

However, the operation speed of the apparatus for displaying graphics as shown in FIG. 1 will be seriously affected when the state number of the state machine is increased. Moreover, as the state number of the state machine increases, the development and maintenance costs of the apparatus will grow substantially.

Then, a configuration is proposed which, by adopting a state partitioning approach and employing a plurality of transform modules corresponding to different states to execute transform operations respectively, improves the graphics displaying speed. In an apparatus adopting the configuration for displaying graphics, an orthogonal algorithm is used to partition the states. However, the complexity of the orthogonal algorithm will grow rapidly with the increased number of the partitioned states.

Hereinafter, the above two apparatus for displaying graphics will be described by constructing mathematical models.

First, in a mathematical model corresponding to the apparatus for displaying graphics as shown in FIG. 1, where supposed that one transform module is used to execute transform operations, the operation of transforming each graphics data into image information can be denoted as $C(x_i, t)$, wherein i denotes the sequence number of the graphics data to be transformed. If there are six graphics data, they will be denoted as $C(x_1, t)$, $C(x_2, t) \ldots C(x_6, t)$ respectively. Apparently, at the same time t, the pixels corresponding to the image information of the six graphics data will be located at different positions on the dimensional axis x. This apparatus for displaying graphics will not cause data overlapping problem when performing the transformations. However, its operation speed, as described above, will be seriously affected when the state number of the state machine is increased.

In a mathematical model corresponding to the apparatus for displaying graphics adopting a state partitioning approach and employing a plurality of transform modules to execute transform operations, the operation of transforming each graphics data into image information can be denoted as $C(X_i, t)$, wherein, $X_i$ is an n-dimensional space vector; n denotes the number of the transform modules configured in parallel according to different graphics types; and i denotes the sequence number of the graphics data to be transformed. Provided that there are six graphics data and meanwhile three transform modules being configured in parallel according to three types of graphics such as point, line and rectangle, then the image information corresponding to the 6 graphics data will be denoted as $C(X_1, t)$, $C(X_2, t) \ldots C(X_6, t)$ respectively, wherein, each $C(X_i, t)$ is a six-dimensional space vector and is a function of time t. It is known from this mathematical model that, in order to prevent the data overlapping problem, every two n-dimensional space vectors must be guaranteed orthogonal when "t"s thereof are the same, i.e., at the same time. Moreover it is known from mathematical principles that the complexity of the orthogonal algorithm is proportional to $n^2$. When the number of transform modules in use increases with the types of graphics, the need for determining whether the n-dimensional space vectors are orthogonal, no matter it is to be executed before or after the transform operations, will surely lead to a substantially complex logic circuit, and the FPGA for executing the operation will become a bottle-neck for the graphics display due to lack of resources.

Consequently, there exists a need for a novel and economical apparatus for displaying graphics that will not be affected by the state number of the state machine and can display graphics quickly.

SUMMARY

An object of the present application is to provide an apparatus and method for displaying graphics, which effectively improve the speed of displaying graphics by reducing the design of complex state machine. Free from being affected by the state number of the state machine, this apparatus and method feature not only easy expansion, but also lower design and maintenance costs.

The present application provides an apparatus for displaying graphics, comprising: a memory to store graphics data and output the graphics data to the bus in series; a plurality of transform modules, wherein, each transform module, based on a type of the graphics outputted to the bus and employing a feedback signal provided by each transform module after a transform operation is executed therein, transforms the corresponding graphics data into image information for the display memory in turn.

The present application provides a method for displaying graphics, comprising the steps of: storing graphics data; outputting the graphics data to the bus in series; transforming the corresponding graphics data into image information for the display memory in turn, based on a type of the graphics outputted to the bus and employing a feedback signal provided by each transform module after a transform operation is executed therein.

With reference to the following descriptions in conjunction with the accompanying drawings, the other objects and achievements will be apparent and appreciated easily.

BRIEF DESCRIPTION OF THE DRAWINGS

Detailed descriptions will be provided below with reference to the accompanying drawings and specific embodiments, wherein.

Throughout the above drawings, similar or corresponding features or functions will be denoted with the same reference numerals.

DETAILED DESCRIPTION

The apparatus for displaying graphics adopts a plurality of transform modules, and each transform module transforms the corresponding graphics data into image information for the display memory respectively. Accordingly, as the graphics data stored in memory are outputted to the bus in series, each transform module, based on the type of the graphics outputted to the bus and a feedback signal provided after a transform operation, transforms the corresponding graphics data into image information for the display memory in turn.

Detailed descriptions are provided below about the apparatus for displaying graphics in conjunction with the specific embodiments.

Figure 1:
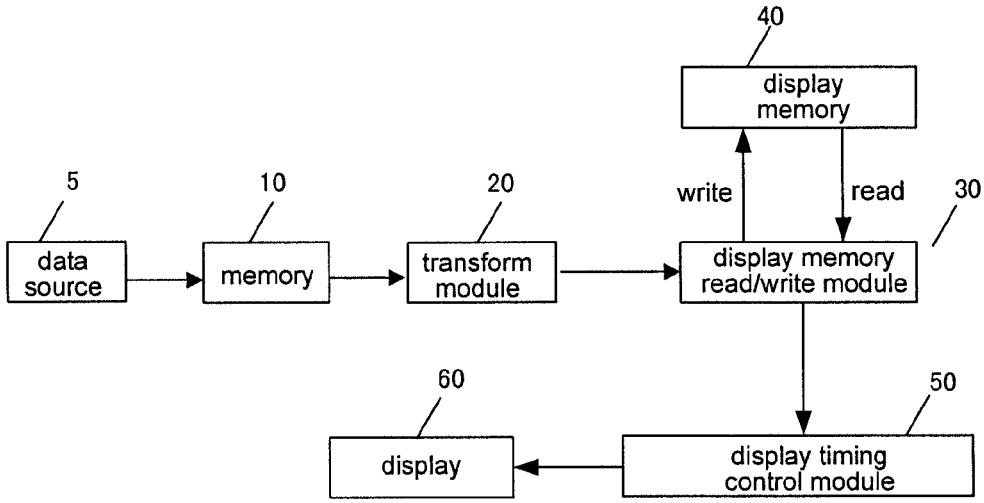
Fig 1 (Prior Art)
FIG. 1 is a schematic diagram illustrating an apparatus with one transform module for displaying graphics in existing monitors.
Figure 2:
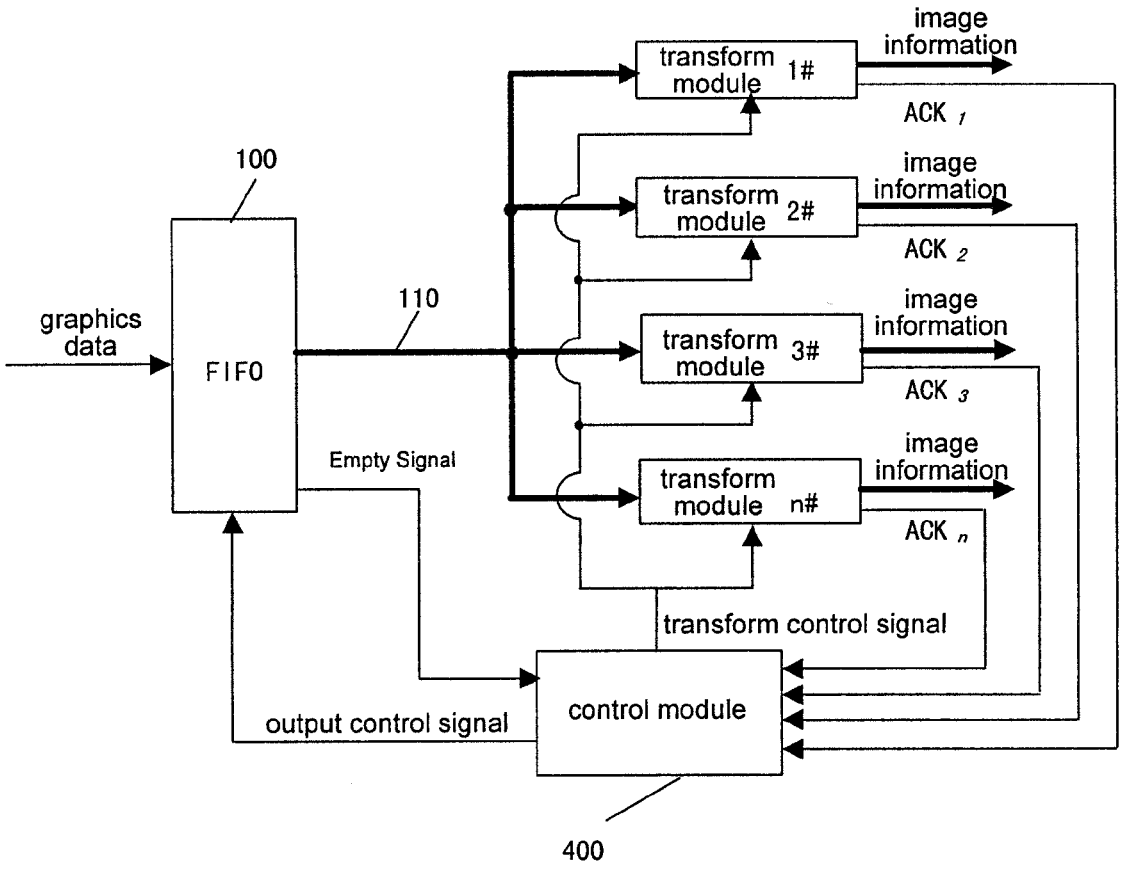
FIG. 2 is a schematic diagram illustrating an apparatus with a plurality of transform modules for displaying graphics according to one embodiment.

FIG. 2 is a schematic diagram illustrating an apparatus for displaying graphics according to the present embodiment. As shown in FIG. 2, first of all, a first graphics data is directly outputted to bus 110 by a show-ahead FIFO memory 100. Here, the use of a show-ahead FIFO memory enables the graphics data being stored into the memory to be outputted to the bus immediately. The graphics data comprises screen coordinates and chroma data for graphics such as point, horizontal line, vertical line, rectangle frame, rectangle block, oblique line and so on, wherein, the screen coordinates may be Cartesian coordinates for example and the chroma data comprises the data such as color or gray level.

Next, each of transform module 1#, transform module 2#, transform module 3#, transform module n#, which is connected with the FIFO memory 100 through the bus, transforms the corresponding graphics data into image information for the display memory based on the types of the graphics outputted to the bus. The image information comprises mapping addresses transformed from the screen coordinates and chroma information transformed according to the color and gray level data. For example, it is assumed that the transform module 1#, the transform module 2# and the transform module 3# are used to transform screen coordinates for graphics such as point, horizontal line, rectangle frame or alike respectively. If the first graphics data is a screen coordinate of a horizontal line, then the transform module 2# will execute corresponding transform operation to obtain the image information for the display memory (not shown in the Figure).

Thereafter, the image information is stored into the display memory according to the mapping address. Then, under the control of display timing, the image information is read out from the display memory and is presented on the screen of a display 60 as the brightness or color of pixels at corresponding positions.

In the apparatus for displaying graphics shown in FIG. 2, the transform modules to process corresponding types of graphics data are configured in parallel, which not only improves the display speed but also reduces the complex design of the state machine. However, if these transform modules process different types of graphics data from the FIFO memory in parallel, data overlapping may result therefrom when it being written into the display memory because the transform modules process different types of graphics data at different speeds. Consequently, in the present embodiment, an acknowledgement signal ACK that is outputted by each transform module after a transform operation therein is used to generate an output control signal such that the graphics data stored in the memory can be outputted to the bus in series. More specifically, by using the acknowledgement signals $ACK_1, ACK_2, ACK_3, \ldots, ACK_n$ that are outputted by the transform modules 1#, 2#, 3#, . . . , N# after a transform operation, control module 400 is enabled to generate an output control signal. Upon receiving the output control signal, the FIFO memory 100 then outputs the next graphics data to the bus 110.

Because the acknowledgement signal ACK is a feedback signal provided by each transform module after the transform operation, by using the output control signal generated by the acknowledgement signal the stored graphics data can be outputted to the bus in series under control of the control module 400. In other words, each transform module will execute corresponding transform operations respectively according to the feedback signals. Therefore, each transform module can transform the corresponding graphics data into image information for the display memory in turn so that the data overlapping problem, which may be caused as the data are written into the display memory by a difference in the respective processing speeds of the different transform modules, can be avoided.

Furthermore, when all the graphics data from the FIFO memory are processed, i.e., the graphics data in the FIFO memory are read empty, a transform control signal is adopted in this embodiment to prevent mis-operations that may be caused by automatically performed transform operations by each transform module on a follow-up graphics data according to the feedback signal. The transform control signal is generated by the control module 400 based on the output control signal and a read-empty signal "Empty" from the output port of the FIFO memory. Each transform module transforms the corresponding graphics data into image information for the display memory according to the transform control signal. In this way, when stored graphics data are read empty, each transform module will not mis-execute the transform operations even if the output control signal is enabled.

Figure 3:
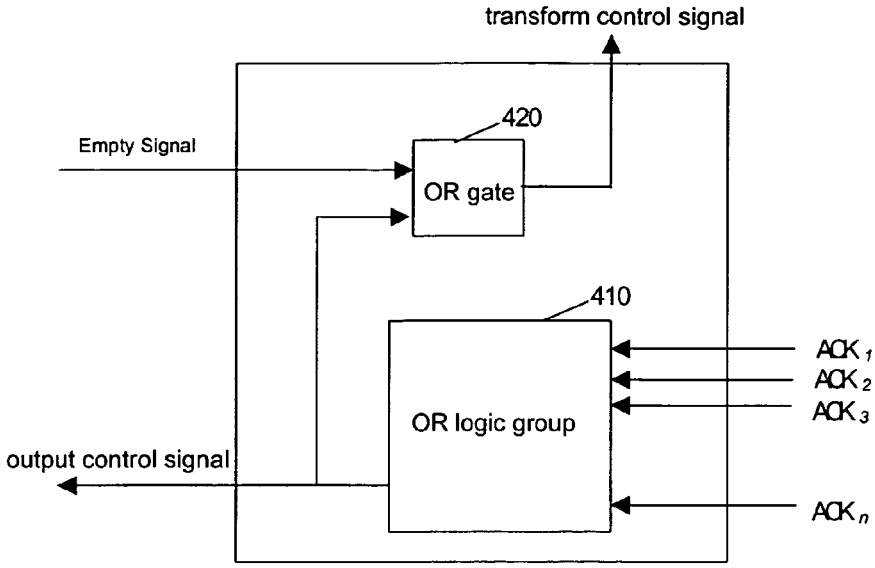
FIG. 3 is a schematic diagram showing a control module adopted by the apparatus for displaying graphics in FIG. 2.

FIG. 3 shows a specific embodiment of the control module 400. As shown in FIG. 3, the acknowledgement signals $ACK_1$, $ACK_2$, $ACK_3$, . . . , $ACK_n$ that are outputted by the transform modules 1#, 2#, 3#, . . . , N# after the transform operations respectively are connected to each input port of an OR logic group 410. When any one of the enabled ACK signals is received, the OR logic group 410 generates the above-mentioned output control signal for controlling the FIFO memory 100 to output the follow-up graphics data to the bus 110 in series.

Further, this output control signal and the read-empty signal "Empty" from the output port of the FIFO memory are inputted respectively to an OR gate 420. If the output control signal is enabled while the graphics data in the FIFO memory are not read empty (i.e. the read-empty signal "Empty" is disabled), the above-mentioned transform control signal is generated by the OR gate 420 such that the corresponding transform module can transform graphics data into image information for the display memory. But when the graphics data stored in the FIFO memory are read empty (i.e. the read-empty signal "Empty" is enabled), even if the output control signal is enabled, the mis-execution of transform operations by each transform module can be prevented under the control of the transform control signal, for example, inputting the transform control signal to the "Empty" port of each transform module respectively.

Figure 4:
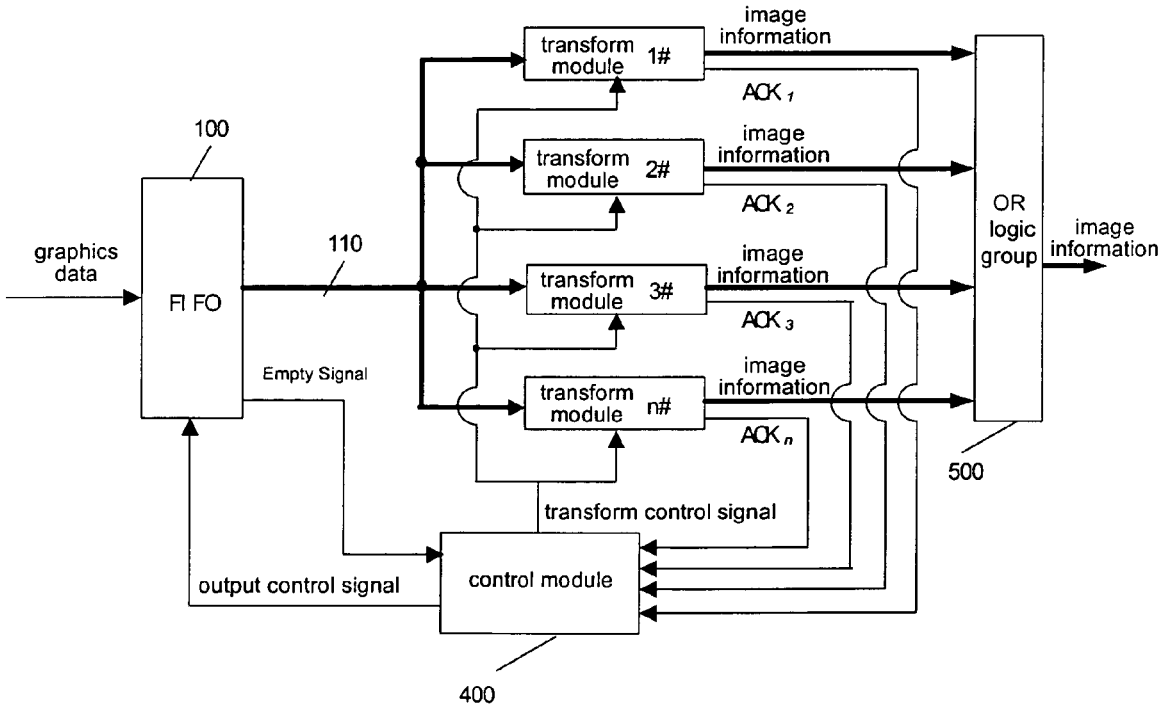
FIG. 4 is a schematic diagram showing an apparatus adopting a plurality of transform modules for displaying graphics according to another embodiment.

FIG. 4 is a schematic diagram illustrating an apparatus for displaying graphics according to another embodiment. As shown in FIG. 4, considering that each transform module transforms the corresponding graphics data into image information for the display memory in turn, the output ports of each transform module may be connected to an OR logic group 500 respectively in order to further save the resources occupied by the system bus. Accordingly, the transformed image information from each transform module are combined by the OR logic group 500, and then outputted in turn to a display memory read/write module (not shown in the Figure). Based on the mapping addresses, this display memory read/write module will store the image information with regard to the corresponding pixels on display screen into the display memory (not shown in the Figure).

The operation mode of the present embodiment, wherein the corresponding transform operations will be executed in turn by adopting a plurality of transform modules and utilizing the feedback signal provided by each transform module after the transform operation, can also be demonstrated by constructing a mathematical model.

In order to reduce complexity, in the mathematical models corresponding to the embodiments, the function of transforming any one graphics data into corresponding image information can be denoted as $C(X_i, a, t)$, wherein, variable a is enabled for one graphics data only at the same time t. The variable a is equivalent to the feedback signal described in the above embodiments. Further, in the case where a plurality of transform modules are configured in parallel to transform the corresponding graphics data into image information for the display memory respectively, any one graphics data can be denoted as $C(X_i, A, t)$, wherein A corresponds to an n-dimensional space vector. In other words, the graphics data are divided into n types, and the transform operation of each type of graphics data will be executed by a corresponding transform module. Because the present embodiment adopts a feedback signal, i.e., variable a is enabled for one graphics data only at the same time, the complex orthogonal algorithm can be avoided.

Advantageous Effects

The above apparatus and method for displaying graphics can display graphics quickly due to that a plurality of transform modules configured in parallel are adopted to transform the corresponding graphics data into image information for the display memory respectively; and because a feedback signal is used to execute the corresponding transform, the apparatus and method achieves not only to readily prevent the data overlapping problem, but also to avoid the complex orthogonal algorithm.

Meanwhile, because a corresponding transform module can be easily added according to the type of a graphics data while not being affected by the state number of the state machine, the apparatus and method feature not only easy expansion, but also lower design and maintenance costs.

Furthermore, by using the transform control signal generated by the read-empty signal "Empty" from the output port of the FIFO memory, each transform module in the apparatus and method for displaying graphics, when stored graphics data are read empty, will not mis-execute a transform operation even if the feedback output control signal is enabled.

In the practical application, there can be various substitute schemes.

For example, the memory for storing the graphics data, apart from being a show-ahead FIFO memory, may also be other FIFO memories or general memories in conjunction with some control signals and/or other signals.

For another example, the output control signal can be generated either depending on the ACK signals provided by the transform modules after the transform operations, or by a control module that generates corresponding control timing according to the transform time of each type of graphics data Similarly, the transform control signal can be generated either depending on the "Empty" signal outputted by the FIFO memory, or by a control module.

For a further example, in the above-described apparatus for displaying graphics, the transform module either can be produced using the FPGA, or can be realized by the ASIC (Application Specific Integrated Circuit), or other programmable logic chips.

Furthermore, the above apparatus and method for quickly displaying graphics can be applied to either monitors, or other display equipment, for example, the consumer electronic equipment.

It should be understood by those skilled in the art that various modifications may be made to the apparatus and method for quickly displaying graphics as disclosed in the present application without departing from the scope of the present invention. The scope of the present invention is to be defined in the appended claims herewith.

What is claimed is:

1. An apparatus for displaying graphics, comprising:

a bus;

a graphics data memory to store graphics data and output the graphics data to the bus in series, the graphics data memory comprising:

an output port to generate a read-empty signal based on the content of the graphics data memory, and an output control selector to cause the graphics data memory to output the graphics data to the bus based on an output control signal;

a display memory;

a plurality of transform modules, wherein, each transform module is configured to transform a corresponding type of graphics data from the bus into image information for the display memory in turn, and wherein each transform module comprises a transform control selector to selectively enable the respective transform module in response to receiving a transform module control signal; and a control module to receive a plurality of acknowledgement signals, each acknowledgement signal provided by a respective transform module after a transform operation is executed therein, and the read-empty signal, the control module comprising:

a first OR logic circuit configured to generate the output control signal based on the plurality of acknowledgement signals; and a second OR logic circuit configured to generate the transform module control signal based on the output control signal and the read-empty signal.

2. The apparatus for displaying graphics of claim 1, further comprising:

an output module connected to the output ports of said a plurality of transform modules respectively so as to provide said transformed image information to said display memory after combination.

3. The apparatus for displaying graphics of claim 2, wherein, said output module comprises an OR logic group.

4. The apparatus for displaying graphics of claim 1, wherein, said graphics data memory comprises a First In First Out (FIFO) memory.

5. The apparatus for displaying graphics of claim 4, wherein, said FIFO memory is a show-ahead FIFO memory.

6. The apparatus for displaying graphics of claim 1, wherein, said graphics at least comprise any one of point, horizontal line, vertical line, rectangle frame, rectangle block, and oblique line.

7. The apparatus for displaying graphics of claim 1, wherein any of said plurality of transform modules can be manufactured using either a field programmable gate array or an application specific integrated circuit.

8. A method for displaying graphics on a monitor, comprising the steps of:

storing graphics data in a graphics data memory;

outputting the graphics data to a bus in series;

generating a read-empty signal based on the content of the graphics data memory;

a plurality of transform modules receiving a transform module control signal to selectively enable the plurality of transform modules;

transforming the corresponding graphics data into image information for a display memory in turn, based on a type of the graphics outputted to the bus;

each of the plurality of transform modules generating an acknowledgement signal after a transform operation is executed therein;

receiving at a first OR logic circuit the plurality of acknowledgement signals and generating an output control signal based on the plurality of acknowledgement signals provided by the plurality of transform modules;

receiving at a second OR logic circuit the control signal and the read-empty signal and generating the transform module control signal based on the output control signal and the read-empty signal; and outputting follow-up graphics data from the graphics data memory to the bus in series according to the output control signal;

displaying the image information based on the display memory on a monitor display.

9. The method for displaying graphics on a monitor of claim 8, further comprising the step of:

providing said transformed image information to said display memory after combination by an output module.

10. The method for displaying graphics on a monitor of claim 8, further comprising:

outputting follow-up graphics data to the bus in series according to said output control signal.

11. The method for displaying graphics on a monitor of claim 8, wherein:

said graphics at least comprise any one of point, horizontal line, vertical line, rectangle frame, rectangle block, and oblique line.

* * * * *